United States Patent [19]

Walter

[11] 4,280,570

[45] Jul. 28, 1981

[54] DRILL HAMMER

[76] Inventor: Hans-Philipp Walter, Corneliastrasse 23, D-7107 Bad Wimpfen, Fed. Rep. of Germany

[21] Appl. No.: 30,948

[22] Filed: Apr. 17, 1979

[30] Foreign Application Priority Data

Apr. 18, 1978 [DE] Fed. Rep. of Germany ..... 2816737

[51] Int. Cl.[3] ..... E21B 4/14

[52] U.S. Cl. ..... 175/92; 173/73; 173/78; 173/80

[58] Field of Search ..... 175/92; 173/73, 78, 173/80, 131

[56] References Cited

U.S. PATENT DOCUMENTS

| | | | |
|---|---|---|---|
| 1,868,684 | 7/1932 | Bayles | 173/78 |
| 2,661,928 | 12/1953 | Topanelian, Jr. | 173/73 |
| 2,800,884 | 7/1957 | Mori | 173/73 |
| 2,851,251 | 9/1958 | Mori | 173/73 |
| 3,084,673 | 4/1963 | Sears | 173/78 |
| 3,164,214 | 1/1965 | Oelke | 173/73 |
| 3,527,239 | 9/1970 | Boom | 175/92 X |
| 3,768,576 | 10/1973 | Martini | 175/92 |
| 3,854,539 | 12/1974 | Sweeney | 175/92 |
| 4,030,554 | 6/1977 | Kammerer | 173/78 X |
| 4,163,478 | 8/1979 | Adcock | 175/92 |

*Primary Examiner*—William F. Pate, III
*Attorney, Agent, or Firm*—Fred Philpitt

[57] ABSTRACT

An impact and rotary rock drilling tool for operation by compressed air fed through a three-part control unit that contains a valve and duct system and is housed in a cage mounted to an outer tube. A central spindle tube is positively connected to the control unit and guides a main ram as well as an intermediate ram that rests on top of a steel drill member for reciprocating movement therewith. An insert portion secured inside the central spindle tube, which latter may comprise a check valve at its lower end, has partitions separating a plurality of passages with ports arranged in the central spindle tube for selected flow connections.

9 Claims, 7 Drawing Figures

Figures 1A, 1B:
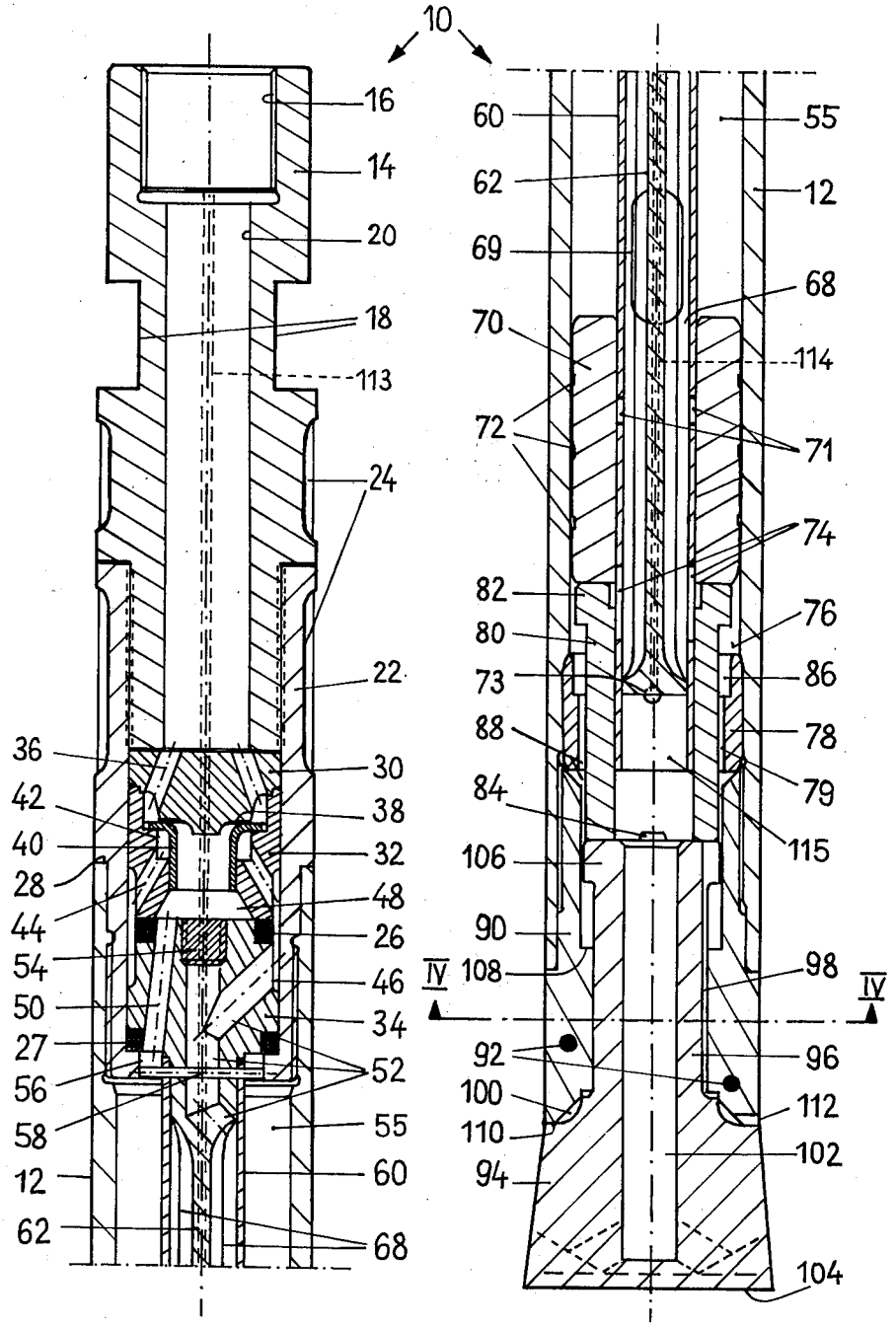

Fig.4
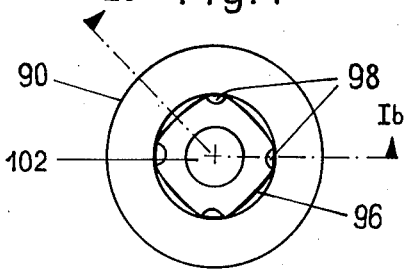
Fig.5
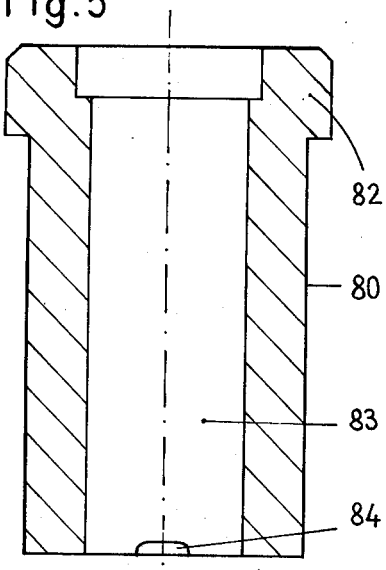
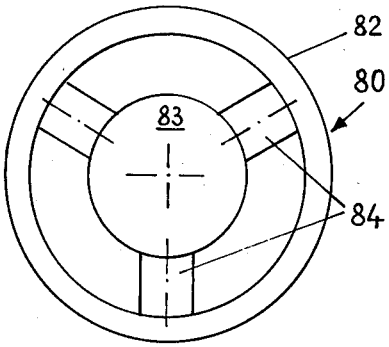
Fig.6
Fig.2
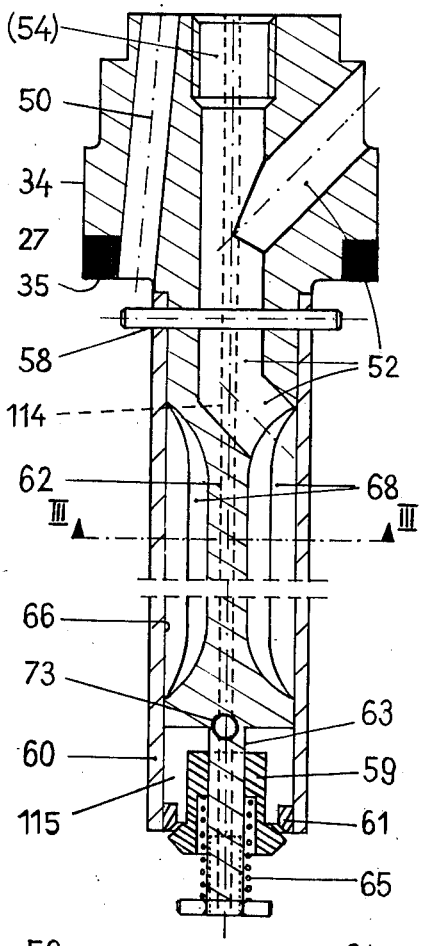
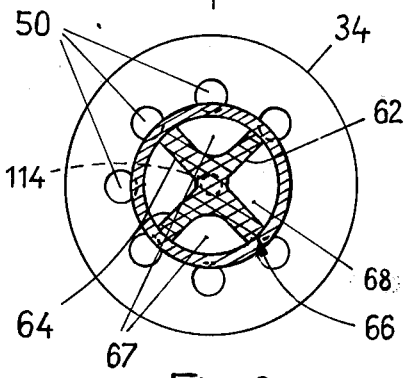
Fig.3

DRILL HAMMER

CROSS REFERENCE TO RELATED APPLICATION

This application discloses subject matter related to pending application Ser. No. 845,099 filed Oct. 25, 1977, which is a continuation of Ser. No. 669,120 filed Mar. 22, 1976.

BACKGROUND OF THE INVENTION

This invention pertains to impact and rotary rock drilling tools and in particular to down hole drill hammers such as disclosed in GB-PS No. 1,542,139.

Designs according to GB-PS No. 1,419,981 and DE-PS No. 23 62 724 incorporating, within an outer tube, an inner central tube that is reciprocating to plunge downwardly into the head of a steel drill member are disadvantageous in that the lower tool portions are subjected to heavy wear and tear resulting in the risk that the steel drill member may get stuck and/or break the lower central tube end. Also, splining provided for rotary slaving of the steel drill member shaft may deteriorate and get jammed under forces and torques which may become excessive when the inner tube is no longer in the center of the outer tube. In rock cavities suddenly reached, drilling may discontinue due to sagging of the steel drill member which is then actually cold-forged by the ram, with corresponding damage to retaining parts.

In a drill according to US-PS No. 3,970,153 there is a piston the lower end of which must slide into an outer tube guide each time, or else the percussion operation would neither get going nor continue. Since upwardly, too, the piston must find its way back onto the lower end of a central projecting tube member, the latter is prone to break under rough operating conditions.

OBJECTS OF THE INVENTION

It is an object of this invention to create a drill hammer of relatively simple design permitting economical manufacture and facilitated maintenance.

The invention also aims at exploiting to the fullest possible extent the cross sectional areas available inside the drill hammer so as to achieve and transmit large impact forces.

It is a further object of the invention to improve the drilling performance of the hammer even under very unfavorable conditions.

Yet another object of the invention is to prevent any cold-forging action of the ram even though the steel drill member may sag in cavities or loose rock.

SUMMARY OF THE INVENTION

Basically, these objects are obtained by providing in a drill hammer adapted for connection to a compressed air source, including a top section which has a through hole and is mounted to a cage means continued by an outer tube, said cage means supporting a control unit that comprises passages, an axially movable valve and a central spindle tube, said outer tube guiding a ram that is arranged for reciprocating sliding movement along said central spindle tube at whose lower end there is a radially divided retainer the inner profile of which is shaped to match the outer profile of a steel drill member for transmitting rotary power, said steel drill member being adapted to reciprocate under the force of said ram and under pressure from said compressed air source and further comprising an upper end contained in said retainer, a shaft with a main axial bore and a crown, the improvement wherein an intermediate ram is guided for reciprocating movement on said central spindle tube and is interposed between said main ram and said upper end of said steel drill member, said central spindle tube being positively connected to said control unit which includes ring pad means.

Owing to this design, the drill hammer will either operate intermittently with the percussion effect to be turned on or off as desired, or continuously throughout. The main ram impact will be transmitted to the steel drill by means of the intermediate ram which is important for buffering and also for improving the flow of the compressed air. Even when the intermediate ram is in or near its lowermost position or when the steel drill member sags, the main ram will be air-cushioned and thus be prevented from directly hitting the intermediate ram while continuing to reciprocate and produce compressed air pulses.

Thus no-load cold-forging either of the intermediate ram head or of the steel drill head is impossible. Accurate guidance of the intermediate ram especially in a sleeve means inserted in the outer tube provides for long-time safe operation and perfect control, in contrast to prior art embodiments such as disclosed in US-PS No. 2,661,928 where an upper piston and a lower piston may easily become misaligned and where there is absolutely no buffering effect.

SPECIALIZATIONS OF THE INVENTION

The features of the present invention yield substantial advantages in view of economical manufacture and, in addition, warrant a secure positive connection between the central spindle tube and the control unit. The structure is solid and non-sophisticated so that considerable savings are possible in production and assembly, while control is improved by wide ducts particularly in the intermediate control unit portion enhancing the flow of both intake and exhaust air.

The fluted outer profile of the cage means of the present invention greatly facilitates unscrewing the hammer for maintenance, whereas some conventional drilling tool sections cannot be detached at all and others have very thin jackets that may even constitute predetermined breaking points. It is important that with the drill hammer of the invention, a closed tool can be applied by temporarily inserting bolts to the profile periphery.

The present invention provides a multi-channel central-tube control system of particularly high operational reliability. A system of four passages by way of two crossing pairs of opposite exhaust and backpressure channels is very expedient in that it safeguards unimpeded air flow and prevents jamming of the rams.

The arrangements and dimensioning of the present drilling tool serve for proper adjustments between buffer space and air discharge channels and apertures. Maximum performance is e.g. obtained when the steel drill member is half-sagging, and with increasing drill steel stroke, drilling capacity will in such case decrease until there is only buffering operation. Flutes in the sleeve means are adapted for full impact transmission, if with some delay in buffering and such that the ram movement will not be intercepted or overly impeded. Machining of the central spindle tube is kept to a minimum. Ports may be arranged at suitable positions. A lower bore (of relatively small width) will permit air to flow downwardly even while the intermediate ram is in its lowermost position; it serves for stopping the hammer only. An upper bore may be provided for idling or stopping the hammer. An enlarged intermediate ram head defines, within the sleeve means, the buffering volume in an annular padding space which is flow-connected to the steel drill member and to ambiance by radial outlets at the lower end of the intermediate ram.

Where a steel drill member of disharmonic polygonal profile—which is usually far better than conventional splining—is employed, longitudinal flutes can be provided in the rounded profile edges for free air flow without any loss of the useful cross sectional area and in whatever axial position of the steel drill member.

A check valve protects the hammer interior and also prevents "standing" air pads that would be quickly overheated due to high frequency adiabatic compression. If desired, plug means for partly or wholly closing an axial exhaust port in a control unit portion may be designed to form a nozzle or may be replaced by a fixture holding a small central tube that, is extended downwardly by a bore for introducing water and thus enabling water hammer operation.

IN THE ANNEXED DRAWINGS

FIGS. 1*a* and 1*b* show adjoining parts of an axial sectional view of a drill hammer embodiment according to the invention, with the lower half of FIG. 1*b* corresponding to line I*b*—I*b* in FIG. 4, FIG. 2 is an axial sectional view of a lower control unit portion including a central spindle tube, FIG. 3 is a cross sectional view corresponding to line III—III in FIG. 2, without a securing pin shown there, FIG. 4 is a cross sectional view corresponding to line IV—IV in FIG. 1*b*, FIG. 5 shows an enlarged axial sectional view of an intermediate ram, and FIG. 6 is a bottom view of the intermediate ram of FIG. 5.

DESCRIPTION

A drill hammer 10 has an outer tube 12 and a top section 14 which is provided with a threaded fitting 16, with key flats 18 and with a through hole 20. Depending on the power system available for operating the drill hammer 10, a suitable fitting can be mounted thereto by simply exchanging the top section 14. The latter is screwed to a cage 22 which in turn is screwed to the outer tube 12. For the screwing and unscrewing operations required during assembly and disassembly, cage 22 has an outer fluted profile 24 for receiving a closed tool (not shown) to be fixed by at least one bolt or pin that is inserted in a flute. A similar profile can be provided at other portions of the drill hammer 10, too, e.g. at the lower end of its outer tube 12.

Within the cage 22, the upper portion 30 of a three-part control unit is supported by a shoulder 28 and by ring pads 26, 27 which may consist of an elatomer such as polyurethane. The upper control unit portion 30 comprises a circumferentially arranged plurality of inclined passages 36 and, at its bottom, a valve seat 38 for a valve body 40 that is centrally guided in the medium or central portion 32 of the control unit. Valve body 40 is adapted for reciprocal movement between valve seat 38 and a support 42 in central portion 32 which contains a circumferential array of oblique passages 44. Axially adjacent valve body 40, there is a chamber 48.

Lateral passages 46 in central portion 32 lead to exhaust ports 52 in the top of lower control unit portion 34. An axial duct among ports 52 is (partly or wholly) closed by a thread plug 54 which can readily be replaced by a nozzle of any desired size. A plurality of intake bores 50 is arranged circumferentially in lower portion 34 for flow connection between chamber 48 and an elongated annular chamber 55 within outer tube 12.

An inset portion 62 that is integral with lower control unit portion 34 supports a central spindle tube 60 which comprises, as shown in FIGS. 2 and 3, several partitions 64 arranged starwise. Lands 66 of partitions 64 abut radially at the inner wall of central spindle tube 60 to which they can be welded, soldered or otherwise adhered. For further securing, a screw connection (not shown) can be provided. Alternatively or in addition, a transverse pin 58 may be tightly fitted, below a shoulder 35 of lower portion 34, through inset portion 62 and central spindle tube 60 up to the inner walls of a collar 56 at the lower end of cage 22.

Inset portion 62 may be as long as central spindle tube 60 but is preferably somewhat shorter, as seen in FIGS. 1*b* and 2. In an embodiment shown in FIG. 2, the lower end of central spindle tube 60 may comprise a re-entering collar 61 which is chamfered so as to form a facing valve seat for a matching valve sleeve 59 of a check valve. Sleeve 59 is slidably arranged on a support pin 63 extending from the lower end of inset portion 62 and carrying locked nuts 63*a* at the threaded end of pin 63. A valve spring 65 is inserted between nuts 63*a* and sleeve 59 which surrounds part of spring 65.

As will be seen from FIG. 1*b* in connection with FIG. 3, partitions 64 form a plurality of passages, preferably two crossing pairs. One pair includes two exhaust passages 67 each of which may open into an elongated exhaust port 69. The other pair constitutes backpressure passages 68 whose cross sectional area is smaller than that of the exhaust passages 67, e.g. by a ration of 2:3. Each backpressure passage 68 is flow-connected, by a lateral venting port 74 at the lower end of central spindle tube 60, to a compression space 76 adjoining outer tube 12 below a main ram 70. Above venting ports 74, an upper bore 71 for idling or stopping operation extends to the exhaust passages 67; below venting ports 74, a smaller lower bore 73 provided for stopping only leads to a chamber 115 (FIG. 1*b*) at the lower end of inset portion 62.

Main ram 70 is guided by outer tube 12 and is provided with peripheral flutes 72 for lubrication. Its lower face is opposite to head 82 of an intermediate ram 80. Both rams 70, 80 are slidably arranged on central spindle tube 60. Head 82 is enlarged with respect to the remaining cylindrical body of intermediate ram 80 and is adapted to plunge into an upper ring chamber 86 in a padding sleeve 78 which is inserted into outer tube 12 from below and is provided with longitudinal grooves 79. At its lower end, intermediate ram 80 comprises two or more radial outlets 84 for establishing flow connection to a lower ring chamber 88; as seen in FIG. 6 as well as FIGS. 1*b* und 5, three radial outlets 84 may be arranged starwise.

A retainer 90 serves to secure both padding sleeve 78 and a steel drill member or bit 94. Retainer 90 preferably consists of two halves joined by pin connectors 92 (FIG. 1*b*) and is screwed into outer tube 12 from below once the shaft 96 of steel drill member 94 has been inserted in retainer 90. Inside, the latter has a disharmonic polygonal profile such as type PC4 disclosed in application Ser. No. 845,099 and in GB-PS No. 1,542,139. Steel drill member 94 comprises an enlarged head 106, and its shaft 96 has an exactly matching polygonal profile also featuring cambered faces and rounded edges as shown in FIG. 4.

Longitudinal flutes 98 are recessed in the rounded edges of shaft 96 for permanent flow connection to an annular padding space 100 at the bottom of retainer 90 and further, via recesses 112 therein, to ambiance, even while a shoulder 110 of steel drill member 94 may engage the lower end of retainer 90. Bit head 106 is adapted to reciprocate and move down to a stop 108 where the polygonal inner profile of retainer 90 ends. A main bore 102 extends way into a crown 104 of steel drill member 94 and ramifies there, as shown by phantom lines in FIG. 1*b*.

Important features of the drill hammer 10 according to the invention are that control is simplified and improved compared to prior art performance, while the general design is very sturdy and warrants excellent utilization of the available space. In practice, drill hammers of 3.2" to 5.3" (80 mm to 135 mm) outer diameter attained, under a pressure of 13 bars, surprising drilling speeds even with very adverse rock conditions.

It will be evident that intermediate ram 80 which is guided in padding sleeve 78 always rests on bit head 106 and thus either completely clears venting ports 74 or shuts them partly or wholly off. When head 82 of intermediate ram 80 has fully plunged into upper ring chamber 86, the adjacent compression space 76 provides sufficient padding to prevent the main ram 70 from hitting head 82. Instead, main ram 70 bounces and in this way permits (under normal conditions) steel drill member 94 and intermediate ram 80 to also return upwardly. Drill hammer 10, which may be attached to a drill string (not shown) and/or to a drilling motor (not shown, either), will by the strokes of main ram 70 continuously produce series of compressed air pulses causing vibration effects as well as gas accelerations that aid the drilling operation, or allowing intermittent service if upper and lower bores 71, 73 are dimensioned accordingly.

Lower ring chamber 88 primarily serves to distribute air evenly to the venting system 98, 100, 112. Bit head 106 may move way down onto shoulder 108 of retainer 90 due to this complete venting action.

Retainer 90 and steel drill member 94 are, owing to their smooth polygonal profiles, highly resistant to wear and reliably ensure large torque and axial force transmission.

The breaking risk of the lower end of the central tube inherent in the prior art is completely removed by the invention. Due to the positive connection of inset portion 62 and/or lower control unit portion 34 to the central spindle tube 60, the latter is effectively protected; it can never be reached by the steel drill member 94.

Further advantages result from the simple structure of the control unit, in particular of its medium and upper portions 32, 30, leading to efficient manufacture and assembly as well as failsafe operation. The functions of drill hammer 10 largely correspond to those disclosed in application Ser. No. 845,099 and in GB-PS No. 1,542,139; however, its versalility and efficiency are much improved. Key flats 18 and fluted profile(s) 24 further contribute towards ease of maintenance and mounting so as to substantially reduce resetting and shutdown times.

Finally, FIGS. 1*a* and 1*b* show by phantom lines a small central tube 113 extending through the upper and medium portions 30, 32 of the control unit and into its lower portion 34 where there is a corresponding central bore 114 (FIG. 3) in the inset portion 62. Through this continuous passage, water can be introduced, thus permitting use of the device as a water hammer. It will be noted that no additional elements or work are required for this purpose; plug 54 can be dispensed with or be substituted by a suitable insert.

While preferred embodiments have been illustrated and explained hereinabove, it should be understood that numerous variations and modifications will be apparent to one skilled in the art without departing from the principles of the invention which, therefore, is not to be construed as being limited to the specific forms described.

What I claim is:

1. In a drill hammer adapted for connection to a compressed air source, including a top section which has a central passageway and is connected to a cage means which in turn is connected to an outer tube, said cage means supporting a control unit that contains passageways, an axially movable valve and a central spindle tube, said outer tube guiding a main ram as well as an intermediate ram for reciprocating sliding movement along said central spindle tube, said intermediate ram being interposed between said main ram and the upper end of a steel drill member, said outer tube further having at its lower end a radially divided retainer, the inner profile of which is shaped to match the outer profile of said upper end of said steel drill member for transmitting rotary power, said steel drill member being adapted to reciprocate under the force of said intermediate ram and under pressure from said compressed air source and further said drill member comprising a shaft with a main axial bore and a crown, the improvement wherein said cage means has an outer fluted profile for engagement by a tool having a matching inner profile, said control unit comprising three portions of which the lowermost portion is connected to said spindle tube by an inset means that is integral with said lowermost portion which is, via a ring pad, supported by a reentering collar located at the lower end of said cage means.

2. A drill hammer according to claim 1 wherein a pin extends diagonally through said central spindle tube and through the upper end of said inset means having lands that are connected to the inner wall of said central spindle tube, either end of said pin extending radially up to said collar.

3. A drill hammer according to claim 1 wherein said lowermost control unit portion has a head with exhaust ports including an axial duct adapted to be at least partly closed by plug means.

4. A drill hammer according to claim 1 wherein said intermediate ram has an enlarged head and a main cylindrical portion which is slidably arranged in a sleeve means that is inserted in said outer tube, said sleeve means being provided with longitudinal flutes, and wherein the lower end of said main cylindrical portion is provided with a plurality of radial outlets.

5. A drill hammer according to claim 4 wherein a lower ring chamber between said intermediate ram and said sleeve means as well as said retainer is flow connected, by means of longitudinal flutes in the rounded edges of said outer profile of said drill steel shaft, to an annular padding space at the lower end of said retainer face-to-face with a shoulder of said steel drill member, said annular padding space permanently opening to its surroundings via recesses at said lower retainer end.

6. In a drill hammer adapted for connection to a compressed air source, including a top section which has a central passageway and is connected to a cage means which in turn is connected to an outer tube, said cage means supporting a control unit that contains passageways, an axially movable valve and a central spindle tube, said outer tube guiding a main ram as well as an intermediate ram for reciprocating sliding movement along said central spindle tube, said intermediate ram being interposed between said main ram and the upper end of a steel drill member, said outer tube further having at its lower end a radially divided retainer the inner profile of which is shaped to match the outer profile of said upper end of said steel drill member for transmitting rotary power, said steel drill member being adapted to reciprocate under the force of said intermediate ram and under pressure from said compressed air source and further said drill member comprising a shaft with a main axial bore and a crown, the improvement wherein said central spindle tube has a plurality of axially separated air passages and includes, between an exhaust port and a venting port, an upper bore opening into two of said axial air passages and further includes a lower bore of smaller width than said upper bore, said lower bore being below said venting port and opening at least into another one of said axial air passages.

7. A drill hammer according to claim 6 wherein said intermediate ram has an enlarged head and a main cylindrical portion which is slidably arranged in a sleeve means that is inserted in said outer tube, said sleeve means being provided with longitudinal flutes, and wherein the lower end of said main cylindrical portion is provided with a plurality of radial outlets.

8. A drill hammer according to claim 7 wherein lands that are positively connected to the inner wall of said central spindle tube are formed by the radial ends of a plurality of partition walls arranged starwise so as to separate an equal number of axial air passages of which at least a first one opens to a venting port in said central spindle tube, said venting port being arranged and dimensioned such that there is no downward connection from said compressed air source whenever said intermediate ram is in its lowermost position, and wherein said central spindle tube is provided with exhaust ports from another two of said axial air passages, each exhaust port being of elongated shape, the length of which is tuned to the stroke of said main ram.

9. A drill hammer according to claim 7 wherein a lower ring chamber between said intermediate ram and said sleeve means as well as said retainer is flow connected, by means of longitudinal flutes in the rounded edges of said outer profile of said drill steel shaft, to an annular padding space at the lower end of said retainer face-to-face with a shoulder of said steel drill member, said annular padding space permanently opening to ambience via recesses at said lower retainer end.

* * * * *